US008388206B2

(12) United States Patent
Cho

(10) Patent No.: US 8,388,206 B2
(45) Date of Patent: Mar. 5, 2013

(54) BACKLIGHT DEVICE, DISPLAY DEVICE AND TELEVISION RECEIVER

(75) Inventor: Shiyoshi Cho, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 262 days.

(21) Appl. No.: 12/918,488

(22) PCT Filed: Oct. 7, 2008

(86) PCT No.: PCT/JP2008/068207

§ 371 (c)(1),
(2), (4) Date: Aug. 20, 2010

(87) PCT Pub. No.: WO2009/110127

PCT Pub. Date: Sep. 11, 2009

(65) Prior Publication Data

US 2011/0069239 A1 Mar. 24, 2011

(30) Foreign Application Priority Data

Mar. 4, 2008 (JP) ..... 2008-052836

(51) Int. Cl.
*H01R 33/00* (2006.01)
*H01J 5/50* (2006.01)

(52) U.S. Cl. ..... 362/581; 362/217.17; 362/97.1; 439/226; 313/318.01

(58) Field of Classification Search ..... 362/581, 362/632, 217.13, 217.17, 97.1, 97.2; 313/318.01; 439/226, 232
See application file for complete search history.

(56) References Cited

U.S. PATENT DOCUMENTS

| | | | | |
|---|---|---|---|---|
| 8,201,958 | B2 * | 6/2012 | Naito | 362/97.1 |
| 8,264,633 | B2 * | 9/2012 | Park et al. | 349/58 |
| 2006/0279957 | A1 | 12/2006 | Kwon et al. | |

FOREIGN PATENT DOCUMENTS

| | | | |
|---|---|---|---|
| CN | 1945786 | A | 4/2007 |
| JP | 35-1874 | Y | 2/1960 |
| JP | 56-49079 | U | 5/1981 |
| JP | 62-2174 | U | 1/1987 |
| JP | 62-4086 | U | 1/1987 |
| JP | 11-329047 | A | 11/1999 |
| JP | 2004-335227 | A | 11/2004 |
| JP | 2007-165208 | A | 6/2007 |

OTHER PUBLICATIONS

Official Communication issued in International Patent Application No. PCT/JP2008/068207, mailed on Dec. 16, 2008.

* cited by examiner

*Primary Examiner* — Karabi Guharay
(74) *Attorney, Agent, or Firm* — Keating & Bennett, LLP

(57) ABSTRACT

There is provided a backlight device with which it is possible not only to prevent an assembly process from being complicated and the number of components from being increased, but also to connect a light source to a connector member satisfactorily and electrically. In this backlight device (20), a distance (W12) from the central axis (O1) of a cold cathode fluorescent lamp (23) to a connector terminal portion (240) is larger than a distance (W2) from the central axis of the cold cathode fluorescent lamp to an end portion of a contact portion (23*d*) of a cap portion (23*a*) in an F direction but is smaller than a distance (L2) from the central axis of the cold cathode fluorescent lamp to an end portion of the contact portion of the cap portion in an E direction.

14 Claims, 11 Drawing Sheets

BACKLIGHT DEVICE, DISPLAY DEVICE AND TELEVISION RECEIVER

TECHNICAL FIELD

The present invention relates to a backlight device, a display device and a television receiver, and more particularly to a backlight device, a display device and a television receiver that include a connector member connected electrically to a light source.

BACKGROUND ART

Conventionally, there are known backlight devices that include a connector member connected electrically to a light source. FIGS. 18 to 21 are diagrams showing the structure of a connector member of one example of the conventional backlight devices. As shown in FIGS. 18 and 19, the example of the conventional backlight devices includes: a light source 501 that has a cap portion 501*a* at its end portion; a connector member 502 that is electrically connected to the cap portion 501*a* of the light source 501; and a support board 503 to which the connector member 502 is attached. The connector member 502 includes a pair of holding plates 502*a* that hold the cap portion 501*a* of the light source 501 from both sides.

In the example of the conventional backlight devices, when the light source 501 is fitted into the connector member 502, as shown in FIG. 20, the pair of holding plates 502*a* of the connector member 502 is pushed and extended outward by the cap portion 501*a* of the light source 501 such that the light source 501 is placed into a predetermined position of the connector member 502. In other words, a predetermined force is applied to the light source 501, and simultaneously the light source 501 is positioned with respect to the connector member 502.

In the example of the conventional backlight devices, even if the light source 501 is not displaced with respect to the connector member 502 (normal state), when the light source 501 is fitted into the connector member 502, a force (reaction force) exerted by the pushing and expanding of the pair of holding plates 502*a* by the cap portion 501*a* of the light source 501 is applied from the connector member 502 to the light source 501. Hence, when the light source 501 is fitted into the connector member 502 with the light source 501 displaced with respect to the connector member 502 (emergency state), even if the force (reaction force) larger than the normal state is applied from the connector member 502 to the light source 501, it is difficult to determine whether or not the force (reaction force) applied from the connector member 502 is larger than the normal state. In other words, it is difficult to determine whether or not the light source 501 is displaced with respect to the connector member 502. Therefore, when the light source 501 is fitted into the connector member 502 with the light source 501 displaced with respect to the connector member 502, it is likely that, as shown in FIG. 21, the holding plates 502*a* are plastically deformed and are thus held extended outward. In this case, the cap portion 501*a* of the light source 501 disadvantageously fails to be connected satisfactorily and electrically to the connector member 502.

Conventionally, there are proposed connector members that can solve the disadvantage described above (for example, see patent document 1).

In this patent document 1, there is disclosed a cold cathode tube connector (connector member) that has: a housing including a contact (contact portion) connected electrically to an electrode wire (contact portion) provided in an end portion of the cold cathode tube (light source); and a cover attached to the housing. The contact of the housing is provided with a pair of movable parts that holds the electrode wire of the cold cathode tube from both sides. The pair of movable parts is spaced apart from each other such that the space therebetween is larger than the diameter of the electrode wire of the cold cathode tube. The cover is provided with actuating protrusions that hold the pair of movable parts from both sides.

When the cold cathode tube is attached to the cold cathode tube connector, the electrode wire of the cold cathode tube is arranged between the pair of movable parts of the housing. Here, since the pair of movable parts is spaced apart from each other such that the space is larger than the diameter of the electrode wire of the cold cathode tube, the electrode wire of the cold cathode tube is arranged between the pair of movable parts without making contact with the pair of movable parts. Thereafter, when the cover is attached to the housing, the actuating protrusions on the cover hold the pair of movable parts of the housing from both sides, and the pair of movable parts of the connector member is electrically connected to the electrode wire of the cold cathode tube.

In patent document 1 described above, when the cold cathode tube is arranged between the pair of movable parts, no force is applied to the cold cathode tube with the cold cathode tube not being displaced with respect to the housing (normal state). Hence, when a force (reaction force) is applied from the housing or the like to the cold cathode tube so that the cold cathode tube is arranged between the pair of movable parts with the cold cathode tube displaced with respect to the housing (emergency state), it is possible to determine that the cold cathode tube is displaced with respect to the housing.

Patent document 1: JP-A-2007-165208

DISCLOSURE OF THE INVENTION

Problems to be Solved by the Invention

In patent document 1, however, in order to electrically connect the electrode wire (connection portion) of the cold cathode tube (light source) to the pair of movable parts of the housing, it is necessary to attach the cover with the actuating protrusions to the housing. Disadvantageously, this causes the assembly process to be complicated and also increases the number of components.

The present invention is designed to overcome the disadvantage described above, and has an object to provide a backlight device, a display device and a television receiver that can prevent an assembly process from being complicated and the number of components from being increased, and that can connect a light source to a connector member satisfactorily and electrically.

Means for Solving the Problem

To achieve the object described above, according to a first aspect of the present invention, there is provided a backlight device including: a light source having a cap portion at an end portion of the light source; and a connector member connected electrically to the cap portion of the light source. In the backlight device, the cap portion of the light source includes a first contact portion extending in a first direction intersecting the axial direction of the light source; the connector member includes a second contact portion making contact with the first contact portion of the cap portion; and a distance from the central axis of the light source to the second contact portion of the connector member is larger than a distance from the central axis of the light source to an end portion of the first contact portion of the cap portion in a second direction intersecting the first direction but is smaller than a distance from the central axis of the light source to an end portion of the first contact portion of the cap portion in the first direction.

In the backlight device according to the first aspect, as described above, since the distance from the central axis of the light source to the second contact portion of the connector member is larger than the distance from the central axis of the light source to the end portion of the first contact portion of the cap portion in the second direction perpendicular to the first direction, it is possible to arrange the second contact portion of the connector member outside of the end portion of the first contact portion of the cap portion of the light source in the second direction, with the end portion of the first contact portion of the cap portion in the second direction pointing toward the second contact portion of the connector member. Thus, with the end portion of the first contact portion of the cap portion in the second direction pointing toward the second contact portion of the connector member, it is possible to arrange the first contact portion of the cap portion in a predetermined position of the connector member (to position it with respect to the connector member) without the first contact portion of the cap portion making contact with the second contact portion of the connector member. Hence, when the light source is arranged in the predetermined position of the connector member with the light source displaced with respect to the connector member (emergency state), it is possible to determine that the light source is displaced, by a force (reaction force) applied from the connector member or the like to the light source, with respect to the connector member of the connector member. Consequently, with the light source not being displaced with respect to the connector member (normal state), it is possible to arrange the light source in the predetermined position of the connector member. The distance from the central axis of the light source to the second contact portion of the connector member is made smaller than the distance from the central axis of the light source to the end portion of the first contact portion of the cap portion in the first direction, and furthermore, the light source is arranged in the predetermined position of the connector member, and then the cap portion is turned about the central axis of the light source such that the end portion of the first contact portion of the cap portion in the first direction is directed toward the second contact portion of the connector member, with the result that it is possible to bring the first contact portion of the cap portion into contact with the second contact portion of the connector member. Consequently, it is possible to connect the light source to the connector member satisfactorily and electrically.

In the backlight device according to the first aspect and configured as described above, the light source is arranged in the predetermined position of the connector member, and then the cap portion is simply turned, and thus it is possible to connect the light source to the connector member satisfactorily and electrically, with the result that it is possible to prevent the assembly process from being complicated. Moreover, it is not necessary to provide a separate member for electrically connecting the light source to the connector member, and thus it is possible to prevent the number of components from being increased.

Preferably, in the backlight device of the first aspect, the connector member includes a plurality of second contact portions, and the plurality of second contact portions of the connector member are arranged such that a space therebetween is larger than the width of the first contact portion in the second direction but is smaller than the length of the first contact portion in the first direction. With this configuration, it is possible to easily make the distance from the central axis of the light source to the second contact portion of the connector member larger than the distance from the central axis of the light source to the end portion of the first contact portion of the cap portion in the second direction but smaller than the distance from the central axis of the light source to the end portion of the first contact portion of the cap portion in the first direction. In this way, it is possible to easily connect the light source to the connector member satisfactorily and electrically.

Preferably, in the backlight device of the first aspect, with the first contact portion of the cap portion not being in contact with the second contact portion of the connector member, the first contact portion of the cap portion is arranged in a predetermined position of the connector member, and the cap portion is thereafter turned a predetermined angle about the central axis of the light source such that the first contact portion of the cap portion is electrically connected to the second contact portion of the connector member. With this configuration, it is possible not only to easily prevent the assembly process from being complicated and the number of components from being increased but also to easily connect the light source to the connector member satisfactorily and electrically.

Preferably, in the backlight device of the first aspect, the second contact portion of the connector member includes a plurality of protrusion portions and a recess portion arranged between the plurality of protrusion portions; and the first contact portion of the cap portion is arranged at the recess portion of the second contact portion of the connector member with the cap portion connected electrically to the connector member. With this configuration, since the first contact portion of the cap portion is sandwiched between the plurality of protrusion portions with the first contact portion of the cap portion arranged at the recess portion of the second contact portion of the connector member, it is possible to prevent the cap portion from being moved (rotated) with respect to the connector member. Thus, it is possible to easily determine whether or not the cap portion is arranged at the recess portion of the second contact portion of the connector member. In other words, it is possible to easily determine whether or not the cap portion is connected to the connector member electrically and satisfactorily. Consequently, it is possible to improve the workability for the assembly. With the first contact portion of the cap portion arranged at the recess portion of the second contact portion of the connector member, it is possible to prevent the cap portion from being moved (rotated) with respect to the connector member, with the result that it is possible to prevent the light source from being disconnected from the connector member after the light source is fitted into the connector member.

Preferably, in the backlight device where the second contact portion of the connector member includes the protrusion portions and the recess portion, the plurality of protrusion portions of the connector member are formed to protrude toward the cap portion. In this configuration, the light source is arranged in the predetermined position of the connector member, and the cap portion is thereafter rotated about the central axis of the light source a predetermined angle, and thus it is possible to easily arrange the first contact portion of the cap portion at the recess portion of the second contact portion of the connector member. This makes it possible to connect the cap portion to the connector member easily and electrically.

Preferably, in the backlight device where the plurality of protrusion portions of the connector member are formed to protrude toward the cap portion, the second contact portion of the connector member is formed with a plate spring; and the first contact portion of the cap portion is arranged in a predetermined position of the connector member, then the cap portion is turned a predetermined angle about the central axis of the light source and thus the first contact portion of the cap portion comes in contact with one of the protrusion portions of the second contact portion of the connector member such that the second contact portion of the connector member protrudes less and that the second contact portion of the connector member stretches in a direction intersecting the axial direction of the light source. With this configuration, it is possible to more easily arrange the first contact portion of the cap portion at the recess portion of the second contact portion of the connector member, and thus it is possible to more easily connect the cap portion to the connector member satisfactorily and electrically. The second contact portion of the connector member is formed with the plate spring, and thus it is possible to easily return, after the first contact portion of the cap portion is arranged at the recess portion of the second contact portion of the connector member, the second contact portion of the connector member to the original shape. In this way, it is possible to easily sandwich the first contact portion of the cap portion between the plurality of protrusion portions of the connector member, with the result that it is possible to easily prevent the light source from being disconnected from the connector member after the light source is fitted to the connector member.

Preferably, in the backlight device where the second contact portion of the connector member is formed with the plate spring, the connector member includes a first regulation portion that regulates the movement of the second contact portion in the axial direction of the light source. With this configuration, when the first contact portion of the cap portion makes contact with the protrusion portion of the second contact portion of the connector member, it is possible to regulate the movement of the second contact portion of the connector member in the axial direction of the light source, with the result that it is possible to easily make the protrusion portion of the second contact portion of the connector member protrude less, and to stretch the second contact portion of the connector member in a direction perpendicular to the central axis of the light source. The first regulation portion is provided in the connector member, and thus it is possible to regulate the movement of the second contact portion of the connector member in the axial direction of the light source, with the result that it is possible to regulate the movement of the light source in the axial direction after the light source is fitted to the connector member.

Preferably, in the backlight device according to the first aspect, the connector member includes a second regulation portion that regulates the movement of the light source in the axial direction of the light source. With this configuration, it is possible to easily regulate the movement of the light source in the axial direction.

Preferably, in the backlight device according to the first aspect, the cap portion is provided with an axis portion which extends in the axial direction of the light source and which is connected to the first contact portion; and the connector member includes an insertion portion into which the axis portion of the cap portion is inserted and which regulates the movement of the axis portion of the cap portion in a direction perpendicular to the axial direction of the light source. With this configuration, the axis portion of the cap portion is inserted into the insertion portion of the connector member, and thus it is possible to easily position the light source with respect to the connector member.

Preferably, in the backlight device according to the first aspect, the cap portion includes two first contact portions and the two first contact portions are arranged symmetrically with respect to the central axis of the light source; and the connector member includes two second contact portions and the two second contact portions are arranged parallel to each other to protrude in a direction perpendicular to the axial direction of the light source. As described above, the cap portion is provided with the two first contact portions arranged symmetrically with respect to the central axis of the light source, and the connector member is provided with two second contact portions, and thus it is possible to evenly apply the force (reaction force) from the connector member to the two first contact portion with the two first contact portions of the cap portion connected electrically to the two second contact portion of the connector member.

Preferably, in the backlight device according to the first aspect, the first contact portion of the cap portion is formed in the shape of a cylinder or a hollow cylinder. With this configuration, when the first contact portion of the cap portion makes contact with the second contact portion of the connector member, it is possible to prevent the first contact portion of the cap portion from being caught in the surface of the second contact portion of the connector member. In this way, it is possible to connect the light source to the connector member easily and electrically.

Preferably, in the backlight device according to the first aspect, a pair of cap portions is arranged on both end portions of the light source in the axial direction of the light source; a pair of connector members is arranged on outsides of the end portions of the light source in the axial direction of the light source; and the second contact portions of the pair of connector members sandwich the pair of cap portions in the axial direction of the light source. In this way, it is possible to connect the light source to the connector member easily and electrically.

According to a second aspect of the present invention, there is provided a display device including the backlight device described above and a display panel illuminated by the backlight device. With this configuration, it is possible to obtain the display device with which it is possible not only to prevent the assembly process from being complicated and the number of components from being increased, but also to connect the light source to the connector member satisfactorily and electrically.

According to a third aspect of the present invention, there is provided a television receiver including: the display device described above; a cabinet housing the display device; a tuner; and a speaker. With this configuration, it is possible to obtain the television receiver with which it is possible not only to prevent the assembly process from being complicated and the number of components from being increased, but also to connect the light source to the connector member satisfactorily and electrically.

Advantages of the Invention

As described above, according to the present invention, it is possible to easily obtain the backlight device, the display device and the television receiver with which it is possible not only to prevent the assembly process from being complicated and the number of components from being increased, but also to connect the light source to the connector member satisfactorily and electrically.

LIST OF REFERENCE SYMBOLS

1 Liquid crystal television receiver (television receiver)
2 Front cabinet (cabinet)
3 Rear cabinet (cabinet)
4 Speaker
5 Tuner
10 Liquid crystal display device (display device)
20 Backlight device
23, 123 and 223 Cold cathode fluorescent lamps (light source)
23*a*, 123*a* and 223*a* Cap portions
23*b* Axis portion
23*d*, 123*d* and 223*d* Contact portions (first contact portions)
24 and 24*a* Connector members
120 Liquid crystal display panel (display panel)
240 Connector terminal portion (second contact portion)
240*a* Protrusion portion
240*b* Recess portion
241*a* Side surface (second regulation portion)
241*c* Side surface (first and second regulation portions)
241*e* Insertion portion
O1 Central axis

BEST MODE FOR CARRYING OUT THE INVENTION

The structure of a liquid crystal television receiver 1 having a backlight device 20 according to an embodiment of the present invention will first be described with reference to FIGS. 1 to 12. The liquid crystal television receiver 1 is an example of a "television receiver" of the invention.

Figure 1:
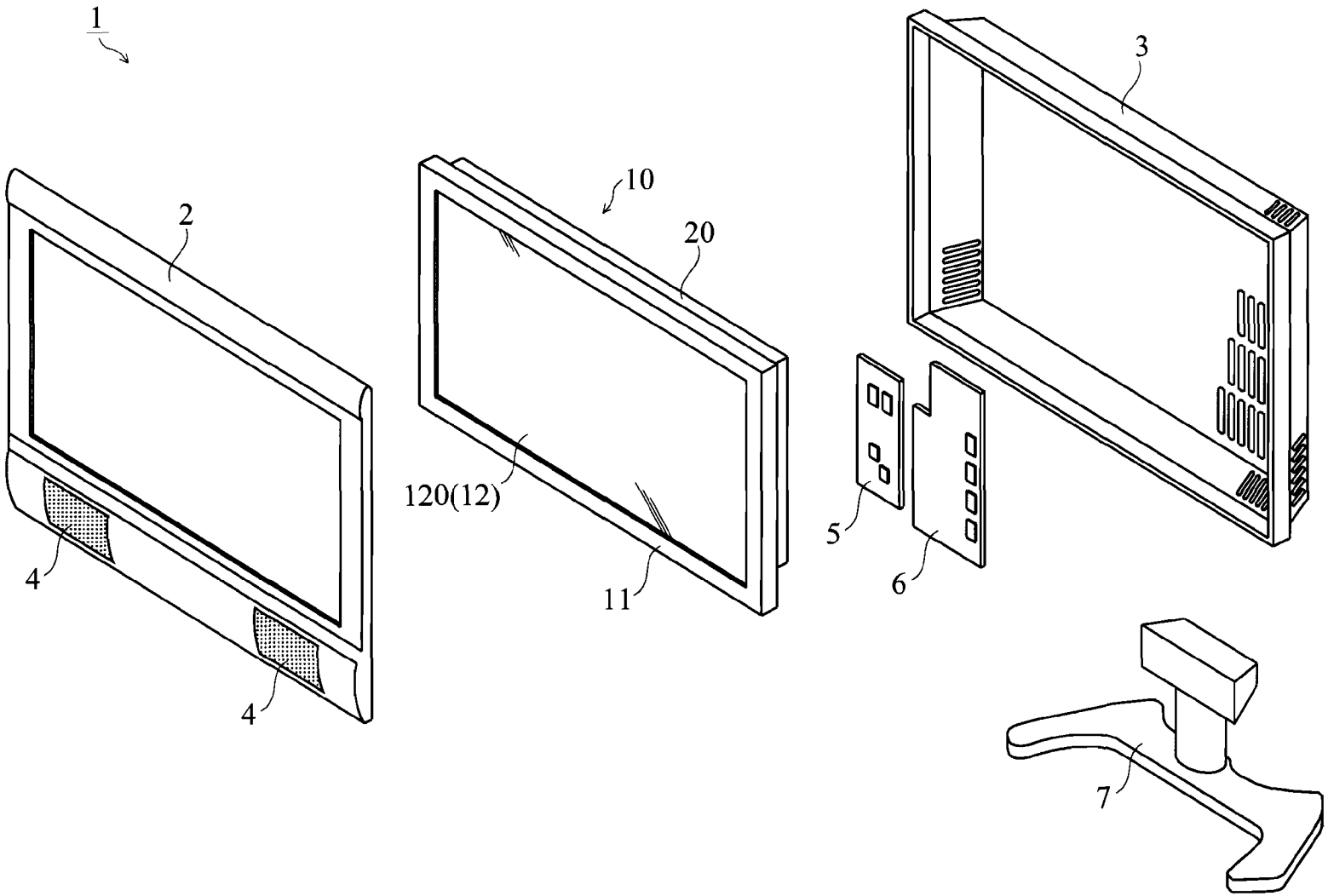
FIG. 1 An exploded perspective view showing the overall configuration of a liquid crystal television receiver having a back light device according to an embodiment of the present invention.

As shown in FIG. 1, the liquid crystal television receiver 1 having the backlight device 20 according to the embodiment of the invention includes: a liquid crystal display device 10 including the backlight device 20; a front cabinet 2 and a rear cabinet 3 that house the liquid crystal display device 10; speakers 4 attached to the front cabinet 2; a tuner 5; a power supply 6; and a support member 7. As the front cabinet 2, the rear cabinet 3, the speakers 4, the tuner 5, the power supply 6 and the support member 7, conventional ones can be used, and thus they will be described briefly. The liquid crystal display device 10 is an example of a "display device" of the invention; the front cabinet 2 and the rear cabinet 3 are an example of a "cabinet" of the invention.

The front cabinet 2 and the rear cabinet 3 house the liquid crystal display device 10, the tuner 5 and the power supply 6. The tuner 5 has the function of generating, from radio waves received, image signals and sound signals for predetermined channels. The speakers 4 have the function of producing sound based on the sound signals generated by the tuner 5. The power supply 6 is configured to supply electric power to the liquid crystal display device 10, the speakers 4 and the tuner 5. The liquid crystal display device 10 is supported by the support member 7. The speakers 4, the tuner 5 and the power supply 6 may be integrally formed with the liquid crystal display device 10.

Figure 2:
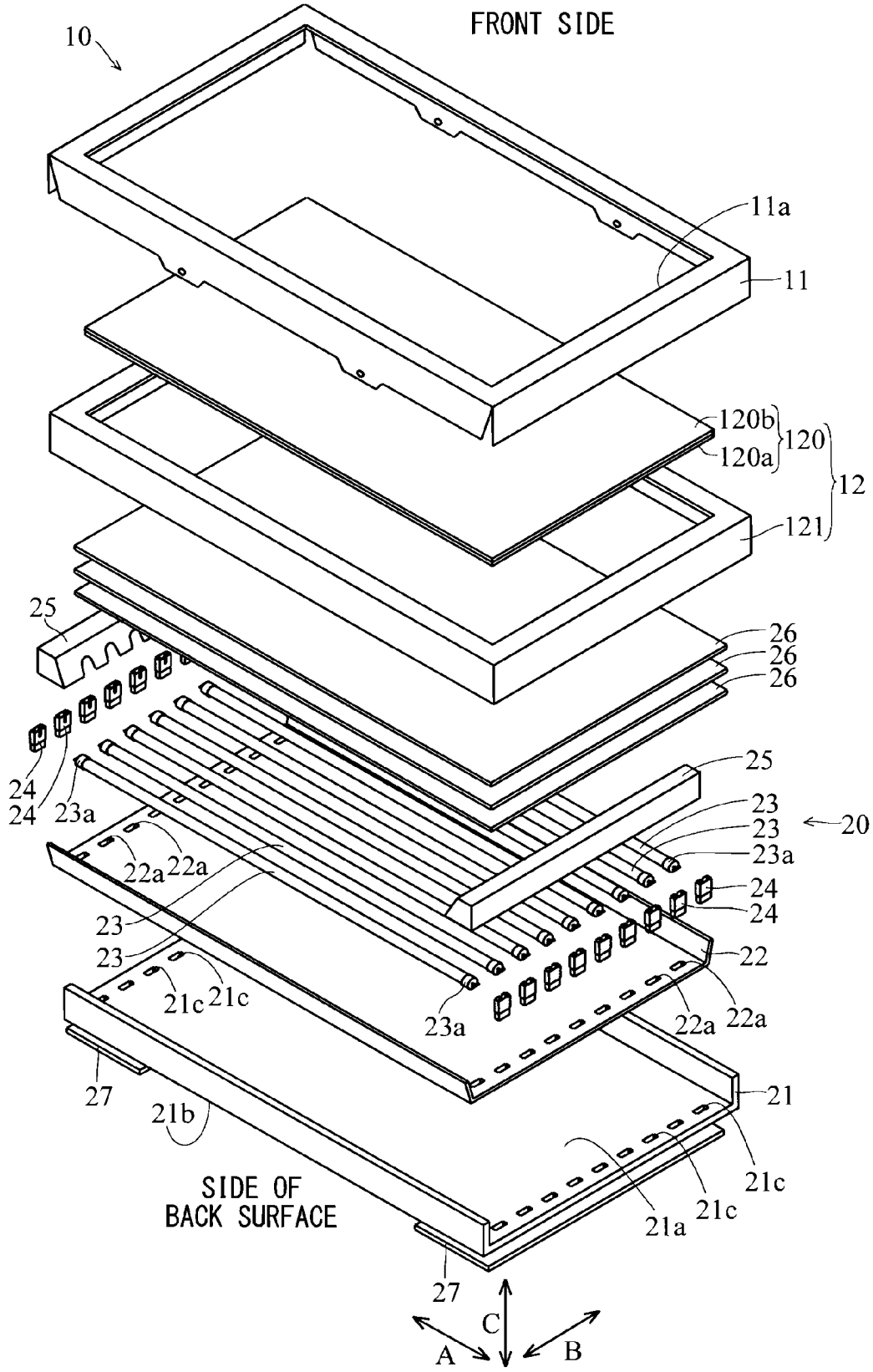
FIG. 2 An exploded perspective view showing the structure of a liquid crystal display device including the back light device according to the embodiment of the invention.

As shown in FIG. 2, the liquid crystal display device 10 is formed with: a bezel 11 having an opening portion 11*a*; a liquid crystal display panel unit 12 whose perimeter is covered by the bezel 11; and the direct type backlight device 20 arranged on the side of the back surface of the liquid crystal display panel unit 12.

The liquid crystal display panel unit 12 is formed with a liquid crystal display panel 120 and a frame-shaped chassis 121 that supports the perimeter of the liquid crystal display panel 120. The liquid crystal display panel 120 includes an AM substrate (active matrix substrate) 120*a* and an opposite substrate 120*b* that is arranged opposite the AM substrate 120*a*. The liquid crystal display panel 120 is illuminated by the backlight device 20 to function as a display panel. The liquid crystal display panel 120 is an example of a "display panel" of the present invention.

In the backlight device 20, a reflective sheet 22, cold cathode fluorescent lamps 23, a plurality of connector members 24 arranged on the outsides of both end portions of the cold cathode fluorescent lamps 23, a pair of cover members 25 that covers the connector members 24 and a plurality of optical sheets 26 are arranged on the side of the front surface 21*a* of the chassis 21. In the backlight device 20, a pair of inverter boards 27 that is electrically connected to the connector members 24 is arranged on the side of the back surface 21*b* of the chassis 21. The cold cathode fluorescent lamps 23 are an example of a "light source" of the present invention.

The chassis 21 is formed with a metal plate composed of an aluminum plate and the like. This chassis 21 has a pair of side portions formed by bending the metal plate vertically toward the front side. In the vicinity of both end portions of the chassis 21 in its longitudinal direction (A direction), a plurality of insertion holes 21*c* are so formed as to be spaced at predetermined intervals in its short side direction (B direction).

The reflective sheet 22 is formed with a sheet member that can diffusely reflect light, and is arranged on the front surface 21*a* of the chassis 21. In the vicinity of both end portions of the reflective sheet 22 in the A direction, a plurality of insertion holes 22*a* are formed in the positions corresponding to the insertion holes 21*c* of the chassis 21. Alternatively, it may be possible to omit the insertion holes 22*a* of the reflective sheet 22 and set the length of the reflective sheet 22 in the A direction shorter than the space between the insertion holes 21*c* of the chassis 21 in the A direction. The sheet member forming the reflective sheet 22 is made of PET (polyethylene terephthalate) resin or the like.

The cold cathode fluorescent lamps 23 are formed with a plurality of straight fluorescent tubes, and are arranged on the front side of the reflective sheet 22. In other words, the back sides of the cold cathode fluorescent lamps 23 are covered by the reflective sheet 22. Thus, part of light emitted from the cold cathode fluorescent lamps 23 is diffusely reflected by the reflective sheet 22 and then travels toward the front side. The cold cathode fluorescent lamps 23 are so arranged as to extend along the A direction, and are spaced in predetermined intervals along the B direction.

Figure 3:
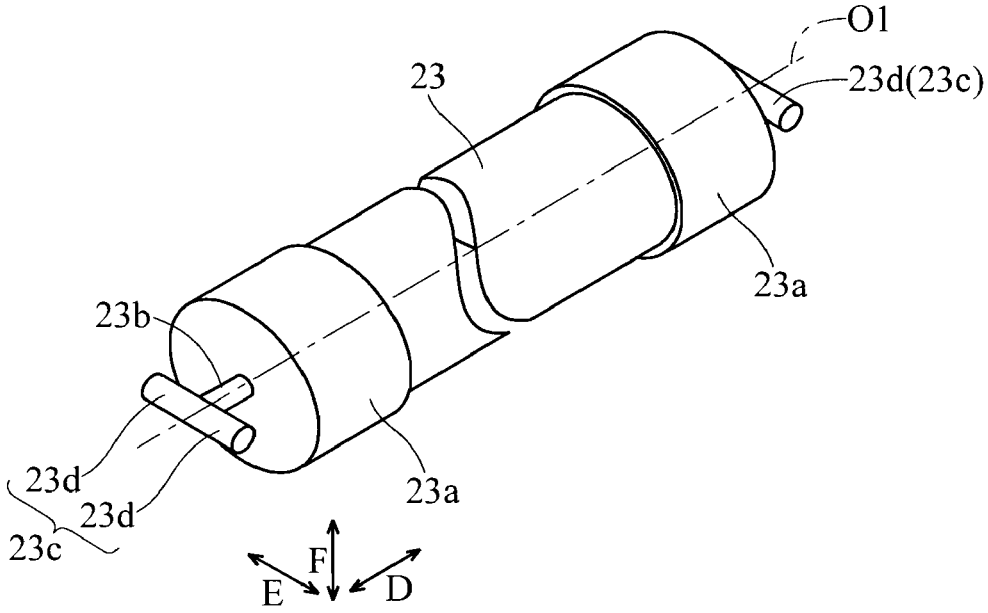
FIG. 3 A perspective view showing the structure of a cold cathode fluorescent lamp of the backlight device shown in FIG. 2.

As shown in FIG. 3, a pair of metal cap portions 23*a* is provided at both end portions of the cold cathode fluorescent lamp 23, and no wire harness is connected thereto.

In this embodiment, each cap portion 23*a* is integrally provided with an axis portion 23*b* that extends in the direction of the axis (D direction) of the cold cathode fluorescent lamp 23 and a cylindrical terminal portion 23*c* that is connected to the axis portion 23*b*. At both end portions of the terminal portion 23*c* in the E direction (direction perpendicular to the D direction), contact portions 23*d* arranged symmetrically with respect to the central axis O1 of the cold cathode fluorescent lamp 23 are provided. The terminal portion 23*c* (contact portions 23*d*) is formed to extend in the E direction of the cold cathode fluorescent lamp 23. The contact portion 23*d* is an example of a "first contact portion" of the present invention; the E direction is an example of a "first direction" of the invention.

Figure 4:
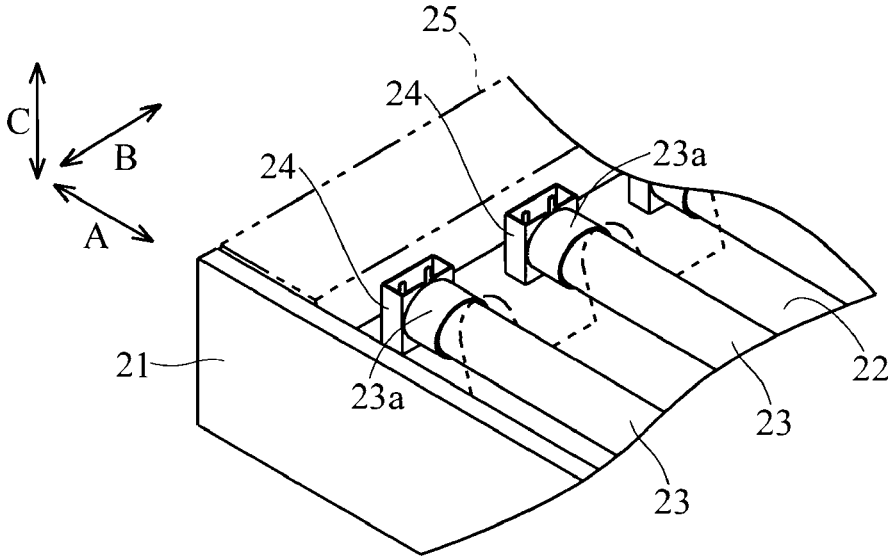
FIG. 4 A perspective view showing the structure of the backlight device shown in FIG. 2.

As shown in FIGS. 2 and 4, a pair of connector members 24 that fixes the cold cathode fluorescent lamp 23 to the chassis 21 and that electrically connects to the cold cathode fluorescent lamp 23 is attached to the pair of cap portions 23*a* of the cold cathode fluorescent lamp 23. As shown in FIG. 2, the connector members 24 are inserted into the insertion holes 22*a* of the reflective sheet 22 and the insertion holes 21*c* of the chassis 21, and are electrically connected to the inverter boards 27. The pair of connector members 24 is arranged to sandwich the cap portions 23*a* of the cold cathode fluorescent lamp 23 in the A direction.

Figure 5:
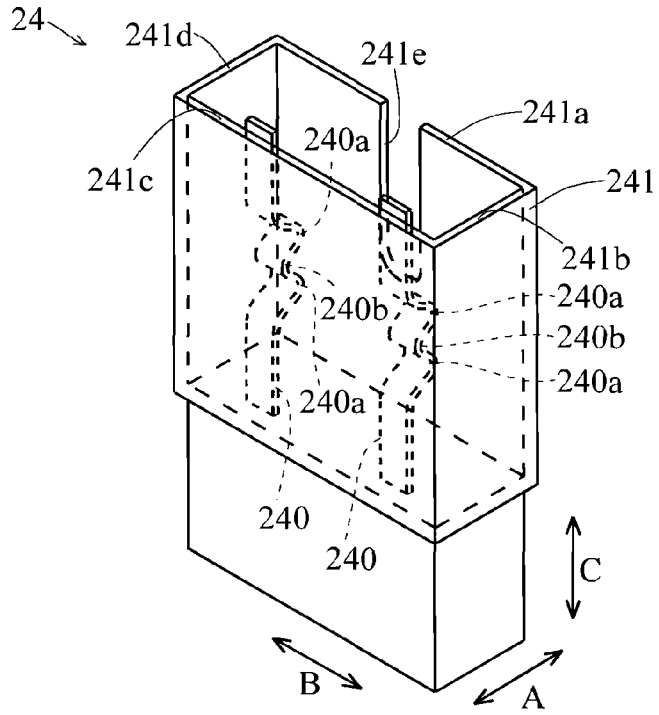
FIG. 5 A perspective view showing the structure of a connector member of the backlight device shown in FIG. 2.

As shown in FIG. 5, the connector member 24 is composed of two connector terminal portions 240 formed with metal plate springs and a main body portion 241 that houses the connector terminal portions 240 and that is formed of resin. The connector terminal portion 240 is one example of a "second contact portion" of the invention.

In the connector terminal portion 240, one end is fixed to the main body portion 241 and the other end is not fixed.

Figure 6:
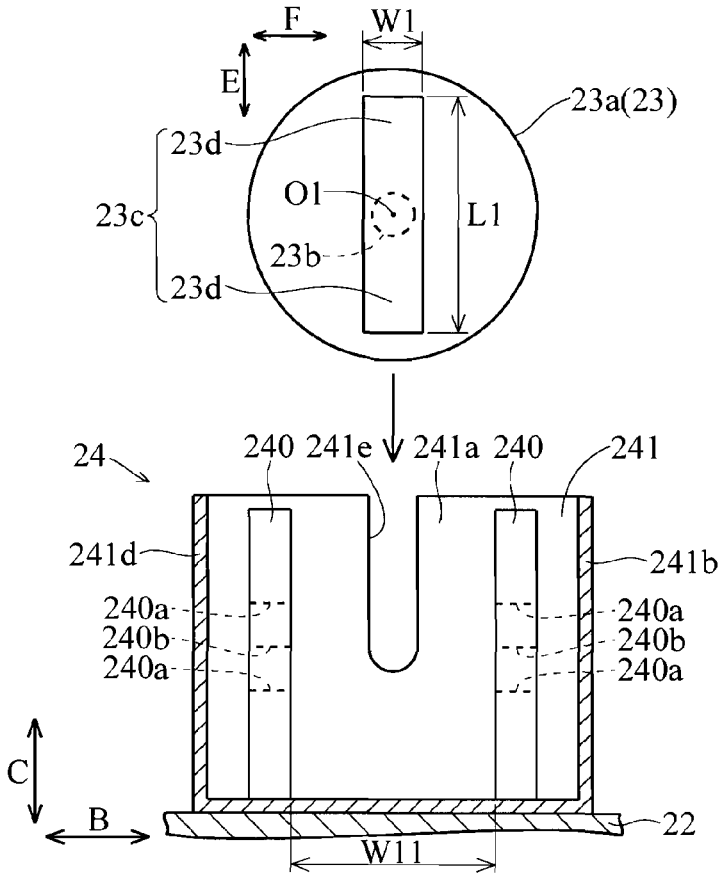
FIG. 6 A cross-sectional view showing the structures of the connector member and the cold cathode fluorescent lamp of the backlight device shown in FIG. 2.
Figure 7:
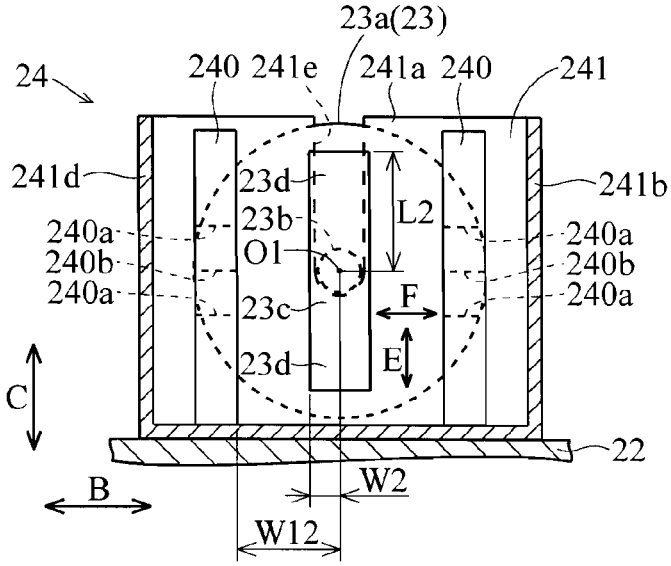
FIG. 7 A cross-sectional view showing the structures of the connector member and the cold cathode fluorescent lamp of the backlight device shown in FIG. 2.

In this embodiment, as shown in FIG. 6, the two connector terminal portions 240 are so arranged parallel to each other as to extend in a C direction (direction perpendicular to the A direction and the B direction) perpendicular to the front surface 21*a* (see FIG. 2) of the chassis 21. Specifically, the two connector terminal portions 240 are arranged such that the space W11 therebetween is larger than the width W1 of the terminal portion 23*c* (contact portions 23*d*) in an F direction (direction perpendicular to the D direction and the E direction) but is smaller than the length L1 of the terminal portion 23*c* (contact portions 23*d*) of the cap portion 23*a* of the cold cathode fluorescent lamp 23 in the E direction. More specifically, as shown in FIG. 7, with the cold cathode fluorescent lamp 23 positioned with respect to the connector member 24, a distance W12 (=W11/2) from the central axis O1 of the cold cathode fluorescent lamp 23 to the connector terminal portion 240 is larger than a distance W2 (=W1/2) from the central axis O1 of the cold cathode fluorescent lamp 23 to the end portion of the terminal portion 23*c* (contact portions 23*d*) of the cap portion 23*a* in the F direction, but is smaller than a distance L2 (=L1/2) from the central axis O1 of the cold cathode fluorescent lamp 23 to the end portion of the terminal portion 23*c* (contact portions 23*d*) of the cap portion 23*a* in the E direction. The F direction is an example of a "second direction" of the present invention.

Figure 8:
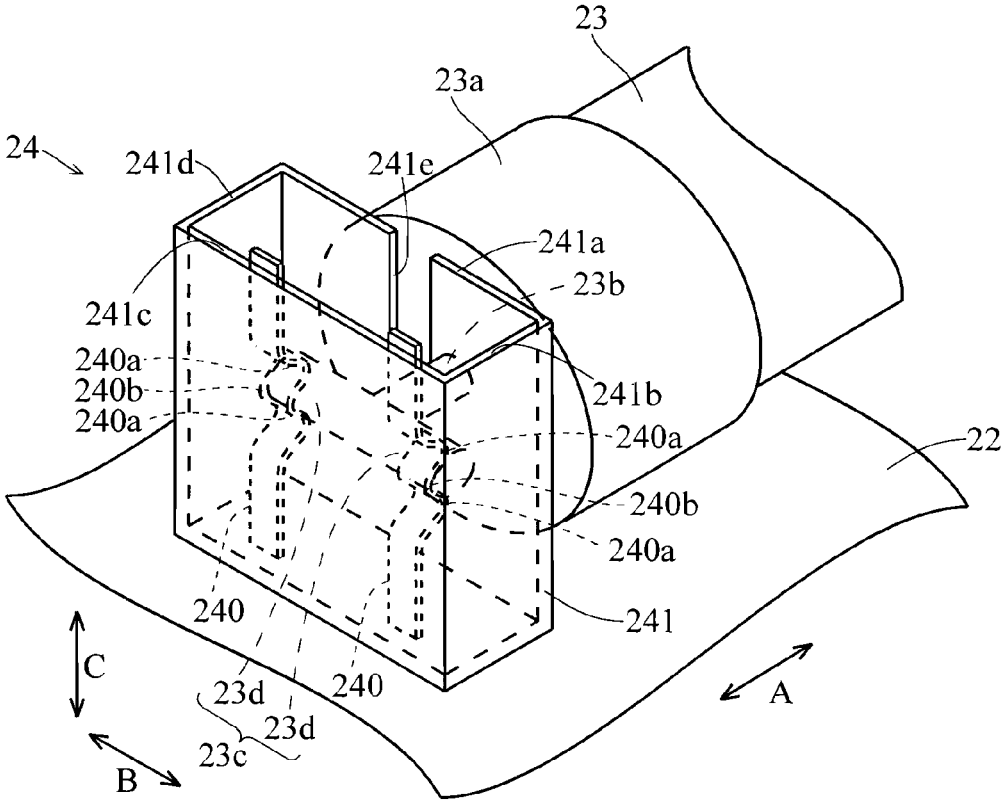
FIG. 8 A perspective view showing the structures of the connector member and the cold cathode fluorescent lamp of the backlight device shown in FIG. 2.
Figure 9:
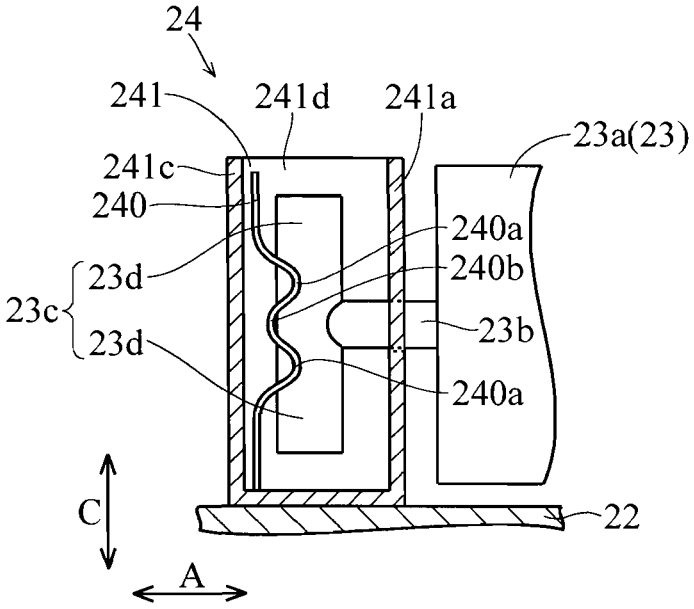
FIG. 9 A cross-sectional view showing the structures of the connector member and the cold cathode fluorescent lamp of the backlight device shown in FIG. 2.
Figure 10:
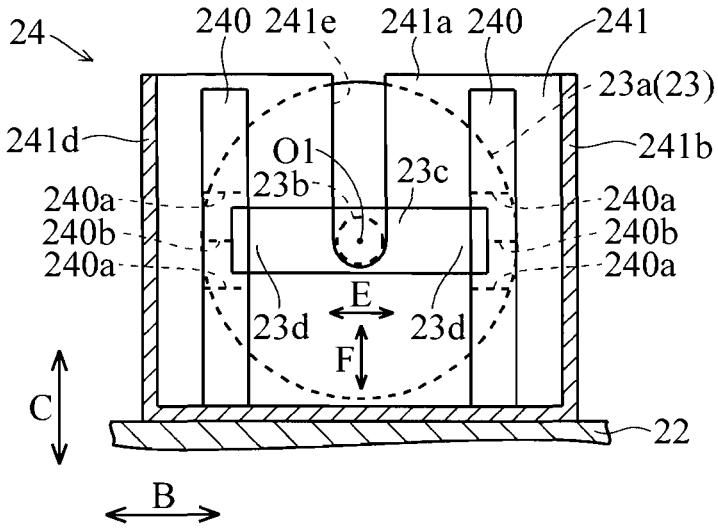
FIG. 10 A cross-sectional view showing the structures of the connector member and the cold cathode fluorescent lamp of the backlight device shown in FIG. 2.
Figure 11:
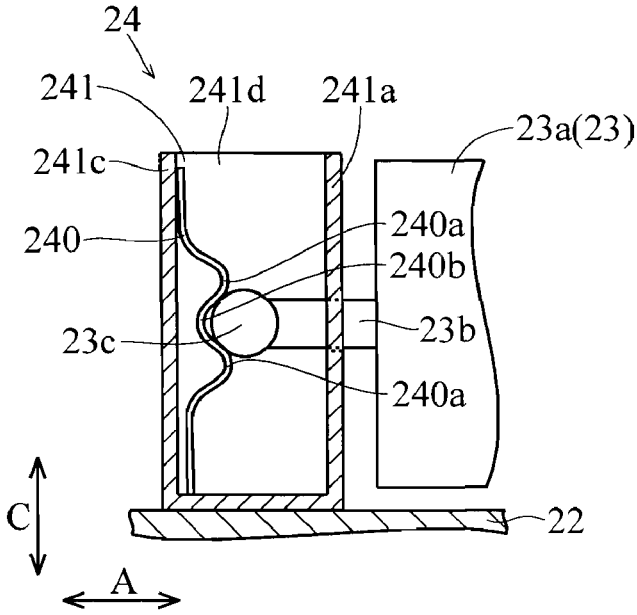
FIG. 11 A cross-sectional view showing the structures of the connector member and the cold cathode fluorescent lamp of the backlight device shown in FIG. 2.

In this embodiment, as shown in FIGS. 8 and 9, in the connector terminal portion 240, two protrusion portions 240*a* that protrude inward (toward the cap portion 23*a* of the cold cathode fluorescent lamp 23) in the A direction and a recess portion 240*b* arranged between the two protrusion portions 240*a* are formed. As shown in FIGS. 8, 10 and 11, with the cold cathode fluorescent lamp 23 connected electrically to the connector terminal portions 240 of the connector member 24, the terminal portion 23*c* (contact portions 23*d*) of the cap portion 23*a* of the cold cathode fluorescent lamp 23 is arranged at the recess portions 240*b*. In other words, the terminal portion 23*c* (contact portions 23*d*) of the cap portion 23*a* of the cold cathode fluorescent lamp 23 is sandwiched between the two protrusion portions 240*a*.

In this embodiment, as described later, when the terminal portion 23*c* (contact portions 23*d*) of the cap portion 23*a* makes contact with the protrusion portions 240*a* of the connector terminal portion 240, the protrusion portions 240*a* protrude less and the connector terminal portion 240 stretches in the C direction.

The main body portion 241 of the connector member 24 has the function of preventing the connector terminal portions 240 from being electrically connected to the chassis 21 and the like. As shown in FIG. 5, the main body portion 241 has four side surfaces 241*a*, 241*b*, 241*c* and 241*d*. The side surface 241*a* is an example of a "second regulation portion" of the present invention; the side surface 241*c* is an example of a "first regulation portion" and the "second regulation portion" of the invention.

In the side surface 241*a*, an insertion portion 241*e* extending in the C direction is formed. As shown in FIG. 8, this insertion portion 241*e* is formed such that the axis portion 23*b* of the cap portion 23*a* of the cold cathode fluorescent lamp 23 is inserted into the insertion portion 241*e*. With the axis portion 23*b* of the cap portion 23*a* of the cold cathode fluorescent lamp 23 inserted into the insertion portion 241*e*, the insertion portion 241*e* functions to regulate the movements of the axis portion 23*b* of the cap portion 23*a* in the B direction and in the C direction toward the chassis 21. When the axis portion 23*b* of the cap portion 23*a* of the cold cathode fluorescent lamp 23 is inserted into the insertion portion 241*e* or with the axis portion 23*b* of the cap portion 23*a* of the cold cathode fluorescent lamp 23 inserted thereinto, the side surface 241*a* also functions to regulate the outward movement of the cold cathode fluorescent lamp 23 in the A direction (D direction).

The side surface 241*c* is formed at a predetermined distance away from the connector terminal portion 240 of the connector member 24 in the A direction. With the terminal portion 23*c* (contact portions 23*d*) of the cold cathode fluorescent lamp 23 attached to the connector terminal portions 240 of the connector member 24, the side surface 241*c* functions to regulate the outward movement of the cold cathode fluorescent lamp 23 in the A direction (D direction).

As described later, when the terminal portion 23*c* (contact portions 23*d*) of the cap portion 23*a* makes contact with the protrusion portions 240*a* of the connector terminal portions 240, the side surface 241*c* functions not only to make the connector terminal portions 240 come in contact therewith but also to prevent the connector terminal portions 240 from being deformed outward in the A direction. Thus, the connector terminal portions 240 are more likely to stretch in the C direction. Alternatively, it may be possible to prevent the side surface 241*c* from making contact with the connector terminal portions 240.

Figure 12:
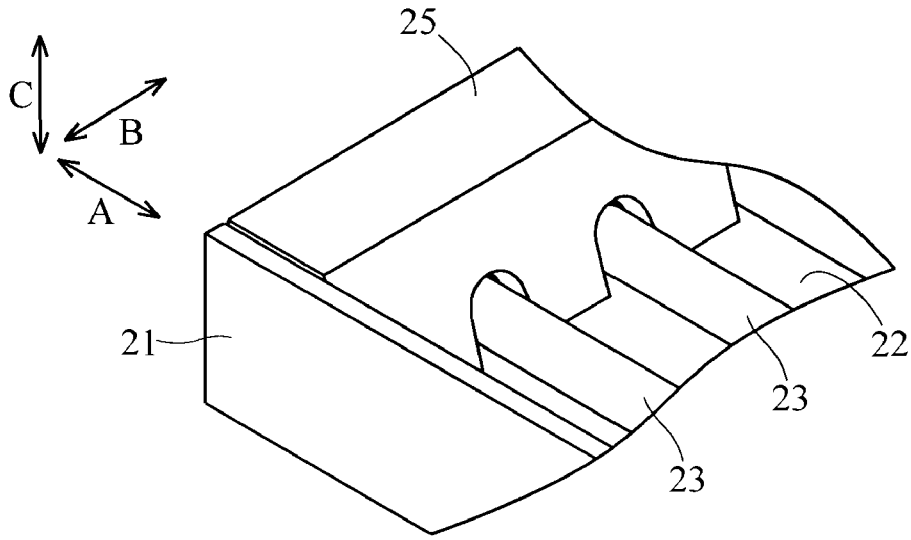
FIG. 12 A perspective view showing the structure of the backlight device shown in FIG. 2.

As shown in FIGS. 4 and 12, the cover member 25 is fixed to the chassis 21 to cover the connector members 24 (see FIG. 4). This cover member 25 has the function of preventing dust and the like from entering between the connector members 24 and the cold cathode fluorescent lamps 23.

As shown in FIG. 2, the optical sheets 26 are composed of a lens sheet, a diffusion sheet and the like, and are arranged on the front side of the cold cathode fluorescent lamps 23. For example, the light emitted from the cold cathode fluorescent lamps 23 is collected and diffused by the optical sheets 26.

A process of fitting the cold cathode fluorescent lamps 23 into the connector members 24 of the backlight device 20 according to the embodiment of the present invention will now be described with reference to FIGS. 6, 7, 9 to 11, 13 and 14.

As shown in FIG. 6, the axis portion 23*b* of the cap portion 23*a* of the cold cathode fluorescent lamp 23 is first inserted into the insertion portion 241*e* of the side surface 241*a* of the main body portion 241 of the connector member 24. Here, the insertion is performed without the terminal portion 23*c* (contact portions 23*d*) of the cap portion 23*a* making contact with the connector terminal portions 240 of the connector member 24. For example, with the terminal portion 23*c* (contact portions 23*d*) of the cap portion 23*a* arranged to extend along the C direction, the axis portion 23*b* is inserted into the insertion portion 241*e*. In this way, as shown in FIGS. 7 and 9, the terminal portion 23*c* (contact portions 23*d*) of the cap portion 23*a* is arranged between the two connector terminal portions 240 of the connector member 24, and the cold cathode fluorescent lamp 23 is positioned at a predetermined position of the main body portion 241 by the insertion portion 241*e* of the side surface 241*a* of the main body portion 241. When the cold cathode fluorescent lamp 23 is positioned at the predetermined position of the main body portion 241, no force (reaction force) is applied from the main body portion 241 to the cold cathode fluorescent lamp 23.

Figure 13:
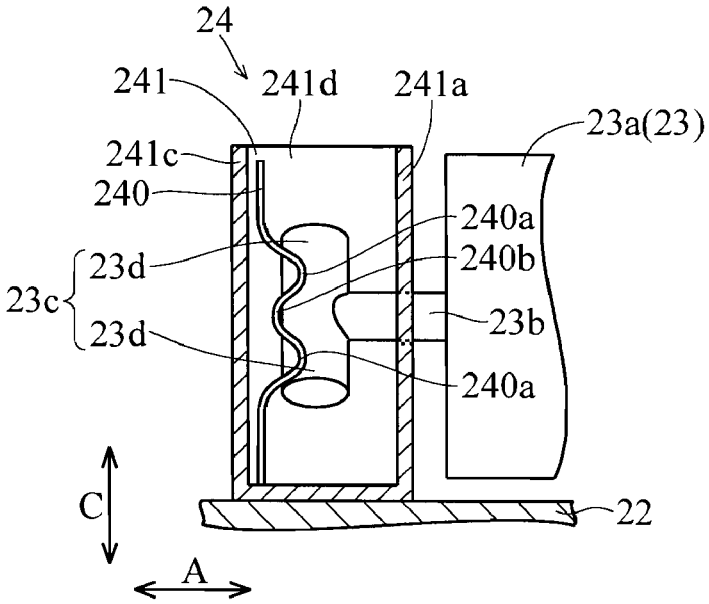
FIG. 13 A cross-sectional view illustrating a process of fitting the cold cathode fluorescent lamp into the connector member of the backlight device shown in FIG. 2.

Then, the cap portion 23*a* of the cold cathode fluorescent lamp 23 is turned a predetermined angle about the central axis O1 (see FIG. 7) of the cold cathode fluorescent lamp 23, and thus, as shown in FIG. 13, the terminal portion 23*c* (contact portions 23*d*) of the cap portion 23*a* of the cold cathode fluorescent lamp 23 makes contact with one of the protrusion portions 240*a* of the connector terminal portion 240 of the connector member 24.

Figure 14:
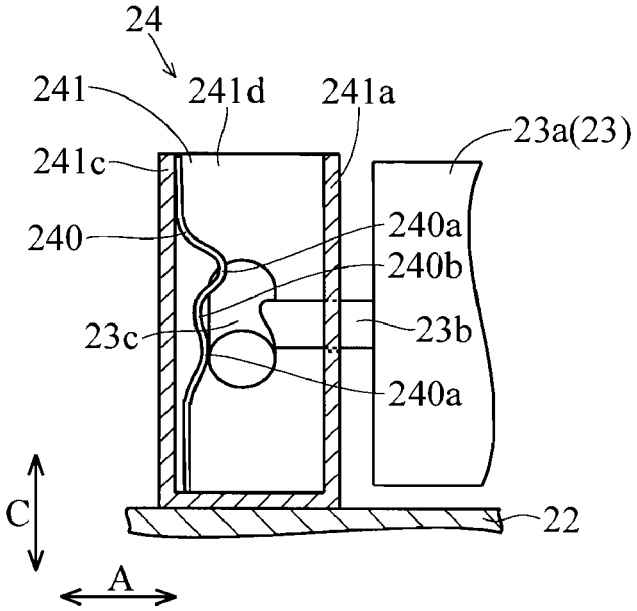
FIG. 14 A cross-sectional view illustrating the process of fitting the cold cathode fluorescent lamp into the connector member of the backlight device shown in FIG. 2.

Then, as shown in FIG. 14, the one of the protrusion portions 240*a* of the connector terminal portion 240 of the connector member 24 protrudes less, and the connector terminal portion 240 stretches in the C direction. Here, the connector terminal portion 240 makes contact with the side surface 241*c* of the main body portion 241. Here, the connector terminal portion 240 may not make contact with the side surface 241*c* of the main body portion 241.

Thereafter, the cap portion 23*a* of the cold cathode fluorescent lamp 23 is further turned about the central axis O1 (see FIG. 4) of the cold cathode fluorescent lamp 23, and thus, as shown in FIGS. 10 and 11, the terminal portion 23*c* (contact portions 23*d*) of the cap portion 23*a* of the cold cathode fluorescent lamp 23 is arranged into the recess portions 240*b* and is sandwiched between the two protrusion portions 240*a*. In this way, the cold cathode fluorescent lamp 23 is connected to the connector terminal portions 240 of the connector member 24 satisfactorily and electrically.

As described above, the cold cathode fluorescent lamps 23 are fitted into the connector members 24 of the backlight device 20.

In this embodiment, as described above, with the cold cathode fluorescent lamp 23 positioned with respect to the connector member 24 (with the axis portion 23*b* of the cap portion 23*a* inserted into the insertion portion 241*e* of the main body portion 241 of the connector member 24), the distance W12 from the central axis O1 of the cold cathode fluorescent lamp 23 to the connector terminal portion 240 of the connector member 24 is made larger than the distance W2 from the central axis O1 of the cold cathode fluorescent lamp 23 to the end portion of the contact portion 23*d* (terminal portion 23*c*) of the cap portion 23*a* in the F direction, and furthermore with the contact portions 23*d* (terminal portion 23*c*) of the cap portion 23*a* arranged to extend in the C direction, the axis portion 23*b* of the cap portion 23*a* is inserted into the insertion portion 241*e* of the main body portion 241 of the connector members 24, with the result that it is possible to position the contact portions 23*d* (terminal portion 23*c*) of the cap portion 23*a* with respect to the connector member 24 (to arrange them in the predetermined position of the connector member 24) without the contact portions 23*d* making contact with the connector terminal portions 240 of the connector member 24. Thus, when the cold cathode fluorescent lamp 23 is positioned with respect to the connector member 24 with the cold cathode fluorescent lamp 23 displaced with respect to the connector member 24 (emergency state), it is possible to determine that the cold cathode fluorescent lamp 23 is displaced with respect to the connector member 24 by a force (reaction force) applied from the main body portion 241 of the connector member 24 and the like to the cold cathode fluorescent lamp 23. Consequently, with the cold cathode fluorescent lamp 23 not being displaced with respect to the connector member 24 (normal state), it is possible to position the cold cathode fluorescent lamp 23 with respect to the connector member 24. The distance W12 from the central axis O1 of the cold cathode fluorescent lamp 23 to the connector terminal portion 240 of the connector member 24 is made smaller than the distance L2 from the central axis O1 of the cold cathode fluorescent lamp 23 to the end portion of the contact portion 23*d* (terminal portion 23*c*) of the cap portion 23*a* in the E direction, and furthermore, the cold cathode fluorescent lamp 23 is positioned with respect to the connector member 24, and thereafter the cap portion 23*a* (cold cathode fluorescent lamp 23) is turned, for example, only an angle of 90 degrees about the central axis O1, with the result that it is possible to bring the contact portions 23*d* of the cap portion 23*a* into contact with the connector terminal portions 240 of the connector member 24. In this way, it is possible to connect the cold cathode fluorescent lamp 23 to the connector member 24 satisfactorily and electrically.

In this embodiment, simply by inserting the cold cathode fluorescent lamp 23 into the insertion portion 241*e* of the main body portion 241 of the connector member 24 and then turning the cap portion 23*a* (cold cathode fluorescent lamp 23), it is possible to connect the cold cathode fluorescent lamp 23 to the connector member 24 satisfactorily and electrically, with the result that it is possible to prevent the fitting process (assembly process) from being complicated. Moreover, since it is not necessary to provide a separate member in order to electrically connect the cold cathode fluorescent lamp 23 to the connector terminal portions 240 of the connector member 24, it is possible to prevent the number of components from being increased.

In this embodiment, the two connector terminal portions 240 of the connector member 24 are arranged such that the space W11 therebetween is larger than the width W1 of the contact portions 23*d* in the F direction but is smaller than the length L1 of the contact portions 23*d* in the E direction. Thus, it is possible not only to easily make the distance W12 from the central axis O1 of the cold cathode fluorescent lamp 23 to the connector terminal portion 240 of the connector member 24 larger than the distance W2 from the central axis O1 of the cold cathode fluorescent lamp 23 to the end portion of the contact portion 23*d* of the cap portion 23*a* in the F direction but also to make the distance W12 smaller than the distance L2 from the central axis O1 of the cold cathode fluorescent lamp 23 to the end portion of the contact portion 23*d* of the cap portion 23*a* in the E direction. Consequently, it is possible to easily connect the cold cathode fluorescent lamp 23 to the connector member 24 satisfactorily and electrically.

In this embodiment, with the cap portion 23*a* connected electrically to the connector member 24, the contact portions 23*d* of the cap portion 23*a* are arranged at the recess portions 240*b* of the connector terminal portions 240 of the connector member 24. In this way, with the contact portions 23*d* of the cap portion 23*a* arranged at the recess portions 240*b* of the connector terminal portions 240 of the connector member 24, the contact portion 23*d* of the cap portion 23*a* is sandwiched between the two protrusion portions 240*a* of the connector member 24, and thus it is possible to prevent the contact portions 23*d* of the cap portion 23*a* from turning with respect to the connector member 24. Hence, it is possible to easily determine whether or not the cap portion 23*a* is arranged at the recess portions 240*b* of the connector terminal portions 240 of the connector member 24. In other words, it is possible to easily determine whether or not the cap portion 23*a* is connected to the connector member 24 electrically and satisfactorily. Consequently, it is possible to improve workability for the fitting (workability for the assembly). Moreover, with the contact portions 23*d* of the cap portion 23*a* arranged at the recess portions 240*b* of the connector terminal portions 240 of the connector member 24, it is possible to prevent the cap portion 23*a* (contact portions 23*d*) from being turned with respect to the connector member 24, and thus it is possible to prevent the cold cathode fluorescent lamp 23 from being disconnected from the connector terminal portions 240 of the connector member 24 after the cold cathode fluorescent lamp 23 is attached to the connector member 24.

In this embodiment, since the protrusion portions 240*a* of the connector member 24 are formed to protrude toward the cap portion 23*a*, it is possible to easily arrange the contact portions 23*d* of the cap portion 23*a* at the recess portions 240*b* of the connector terminal portions 240 of the connector member 24 by turning the cap portion 23*a* (cold cathode fluorescent lamp 23) after the cold cathode fluorescent lamp 23 is positioned with respect to the connector member 24.

In this embodiment, the contact portion 23*d* of the cap portion 23*a* makes contact with the protrusion portion 240*a* of the connector terminal portion 240 of the connector member 24, and thus the protrusion portion 240*a* of the connector terminal portion 240 of the connector member 24 protrudes less, and the connector terminal portion 240 of the connector member 24 stretches in the C direction. In this way, it is possible to more easily arrange the contact portions 23*d* of the cap portion 23*a* at the recess portions 240*b* of the connector terminal portions 240 of the connector member 24, and thus it is possible to more easily connect the cap portion 23*a* to the connector terminal portions 240 of the connector member 24 satisfactorily and electrically.

In this embodiment, since the connector terminal portions 240 of the connector member 24 are formed with the plate springs, it is possible to easily return the connector terminal portions 240 of the connector member 24 to the original shape after the contact portions 23*d* of the cap portion 23*a* are arranged at the recess portions 240*b* of the connector terminal portions 240 of the connector member 24. Thus, it is possible to easily sandwich the contact portions 23*d* of the cap portion 23*a* between the two protrusion portions 240*a* of the connector member 24.

In this embodiment, since the main body portion 241 of the connector member 24 is provided with the side surface 241*c* for regulating the movement of the connector terminal portions 240 in the direction of the axis of the cold cathode fluorescent lamp 23 (D direction), when the contact portions 23*d* of the cap portion 23*a* make contact with the protrusion portion 240*a* of the connector terminal portion 240, it is possible to regulate the movement of the connector terminal portions 240 in the direction of the axis of the cold cathode fluorescent lamp 23 (D direction), with the result that it is possible to stretch the connector terminal portions 240 in the C direction by making the protrusion portions 240*a* of the connector terminal portions 240 protrude less. Moreover, the side surface 241*c* is provided in the main body portion 241 of the connector member 24, and thus it is possible to regulate the movement of the connector terminal portions 240 in the direction of the axis of the cold cathode fluorescent lamp 23 (D direction), with the result that it is possible to regulate the movement of the cold cathode fluorescent lamp 23 in the direction of the axis of the cold cathode fluorescent lamp 23 (D direction) after the cold cathode fluorescent lamp 23 is fitted to the main body portion 241 of the connector member 24.

In this embodiment, since the main body portion 241 of the connector member 24 is provided with the side surface 241*a* for regulating the movement of the cold cathode fluorescent lamp 23 in the direction of the axis of the cold cathode fluorescent lamp 23 (D direction), when the cold cathode fluorescent lamp 23 is fitted to the main body portion 241 of the connector member 24, it is possible to regulate the movement of the cold cathode fluorescent lamp 23 in the direction of the axis of the cold cathode fluorescent lamp 23 (D direction), with the result that it is possible to easily arrange the cold cathode fluorescent lamp 23 in the predetermined position of the connector member 24.

In this embodiment, since the side surface 241*a* of the connector member 24 is provided with the insertion portion 241*e* that has the function of regulating the movement of the axis portion 23*b* of the cap portion 23*a* in the B direction and in the C direction toward the chassis 21, it is possible to easily position the cold cathode fluorescent lamp 23 with respect to the main body portion 241 of the connector member 24 by inserting the axis portion 23*b* of the cap portion 23*a* into the insertion portion 241*e* of the main body portion 241.

In this embodiment, since the cap portion 23*a* is provided with the two contact portions 23*d* arranged symmetrically with respect to the central axis O1 of the cold cathode fluorescent lamp 23 and the connector member 24 is provided with the two connector terminal portions 240, it is possible to evenly apply the force (reaction force) from the connector member 24 to the two contact portions 23*d* of the cap portion 23*a*, with the two contact portions 23*d* of the cap portion 23*a* connected electrically to the two connector terminal portions 240 of the connector member 24.

In this embodiment, since the contact portions 23*d* (terminal portion 23*c*) of the cap portion 23*a* are formed into a cylindrical shape, when the contact portions 23*d* of the cap portion 23*a* make contact with the connector terminal portions 240 of the connector member 24, it is possible to prevent the contact portions 23*d* of the cap portion 23*a* from being caught in the surface of the connector terminal portions 240. In this way, it is possible to easily and electrically connect the cold cathode fluorescent lamp 23 to the connector terminal portions 240 of the connector member 24.

In this embodiment, the pair of connector members 24 arranged on the outsides of both end portions of the cold cathode fluorescent lamp 23 in the direction of its axis (D direction) sandwiches, in the direction of the axis of the cold cathode fluorescent lamp 23 (D direction), the pair of cap portions 23*a* arranged on both end portions of the cold cathode fluorescent lamp 23 in the direction of its axis (D direction), and thus it is possible to easily and electrically connect the cold cathode fluorescent lamp 23 to the connector member 24.

The embodiment disclosed herein should be considered in all respects as illustrative and not restrictive. The scope of the present invention is indicated not by the description of the above embodiment but by the scope of claims, and includes meanings equivalent to the scope of claims and all modifications within the scope.

For example, although the above embodiment deals with the case where the display panel, the display device and the television receiver are applied to the liquid crystal display panel, the liquid crystal display device and the liquid crystal television receiver, respectively, the present invention is not limited to this embodiment, and may be applied to display panels, display devices and television receivers other than the liquid crystal display panel, the liquid crystal display device and the liquid crystal television receiver.

Although the above embodiment deals with the case where the cold cathode fluorescent lamp is used as an example of the light source, the invention is not limited to this embodiment, and can be applied to light sources other than the cold cathode fluorescent lamp.

Figure 15:
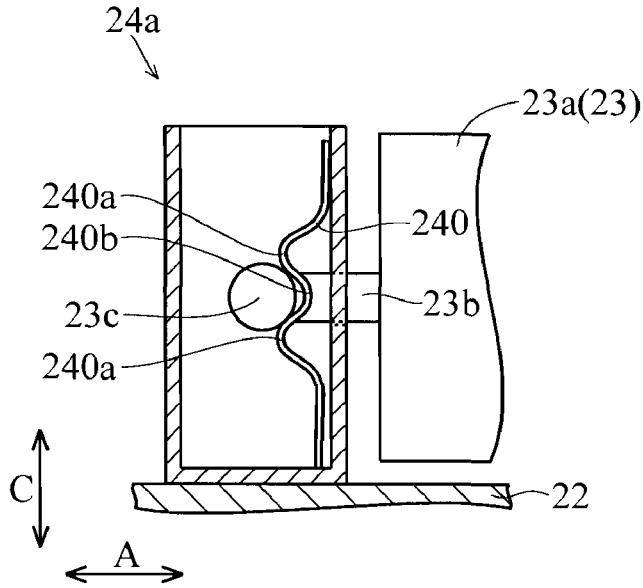
FIG. 15 A cross-sectional view showing the structure of a connector member in a first variation of the invention.

Although the above embodiment deals with the case where the connector terminal portion is arranged outside of the terminal portion of the cold cathode fluorescent lamp in the A direction, the invention is not limited to this embodiment, and, as with a connector member 24*a* in a first variation of the invention shown in FIG. 15, the connector terminal portions 240 may be arranged inside of the terminal portion 23*c* of the cold cathode fluorescent lamp 23 in the A direction.

Although the above embodiment deals with the case where the connector terminal portion is provided with two protrusion portions and one recess portion, the invention is not limited to this embodiment, and the connector terminal portion may be provided with three or more protrusion portions and two or more recess portions.

Although the above embodiment deals with the case where one end of the connector terminal portion is fixed to the main body portion, and the other end of the connector terminal portion is not fixed, the invention is not limited to this embodiment, and both ends of the connector terminal portion may be fixed to the main body portion and the like.

Figure 16:
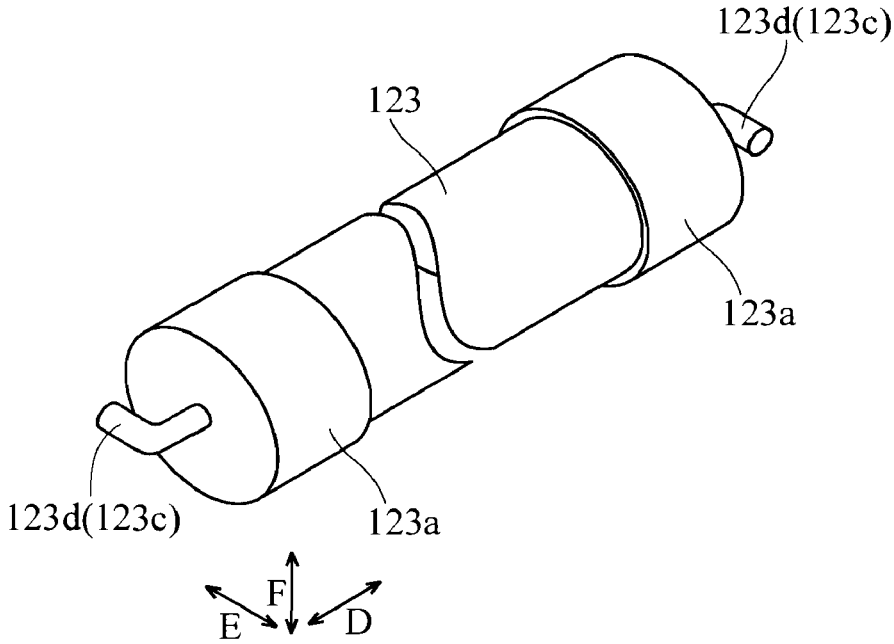
FIG. 16 A perspective view showing the structure of a cold cathode fluorescent lamp in a second variation of the invention.

Although the above embodiment deals with the case where the terminal portion of the cap portion of the cold cathode florescent lamp is provided with two contact portions, the invention is not limited to this embodiment, and, as with a cold cathode fluorescent lamp 123 in a second variation of the invention shown in FIG. 16, a terminal portion 123*c* of a cap portion 123*a* of the cold cathode fluorescent lamp 123 may be provided with only one contact portion 123*d*. The terminal portion of the cap portion of the cold cathode fluorescent lamp may be provided with three or more connection portions.

Although the above embodiment deals with the case where one connector member is provided with two connector terminal portions, the invention is not limited to this embodiment, and one connector member may be provided with one connector terminal portion alone or may be provided with three or more connector terminal portions.

Figure 17:
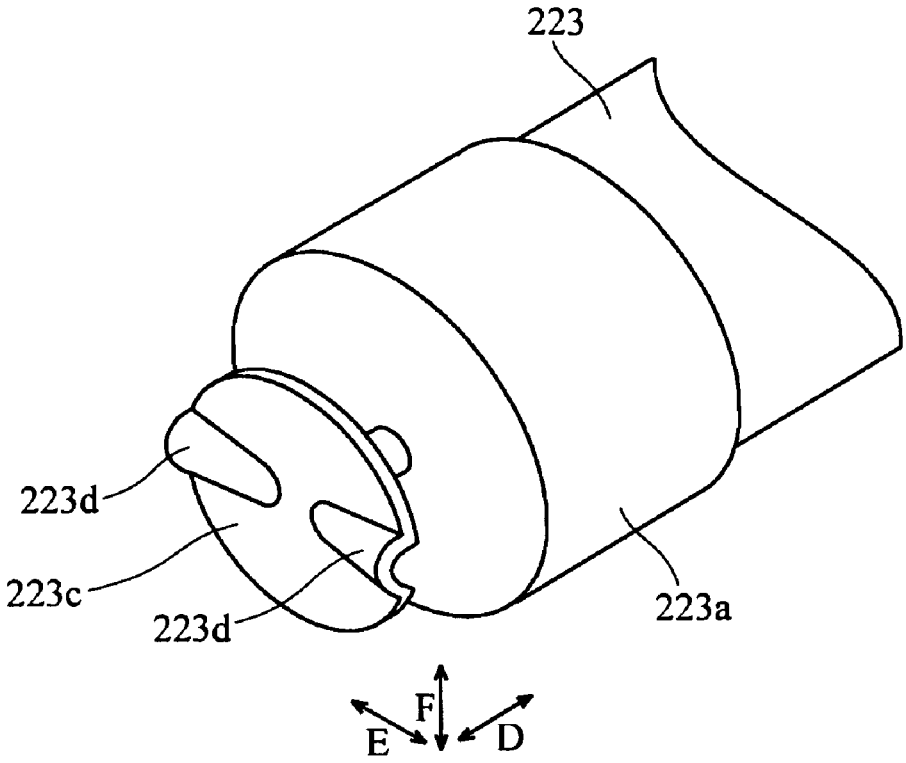
FIG. 17 A perspective view showing the structure of a cold cathode fluorescent lamp in a third variation of the invention.
Figure 18:
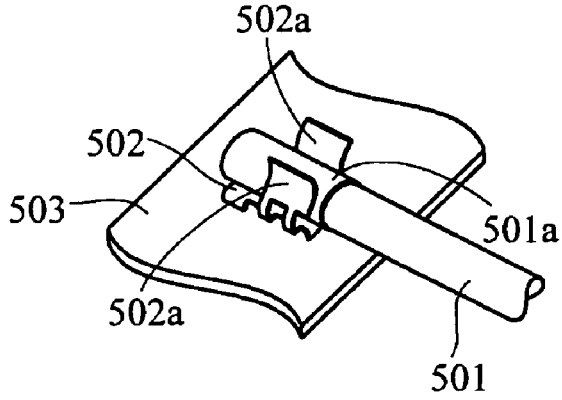
FIG.18 Prior Art
FIG. 18 A perspective view showing the structure of a connector member and a light source of one example of a conventional backlight device.
Figure 19:
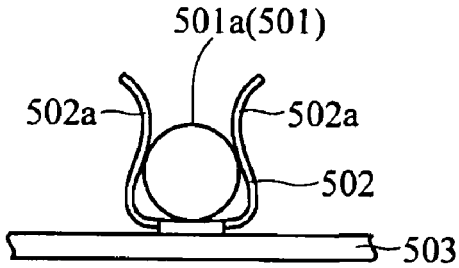
FIG.19 Prior Art
FIG. 19 A front view showing the structure of the connector member of the example of the conventional backlight device shown in FIG. 18.
Figure 20:
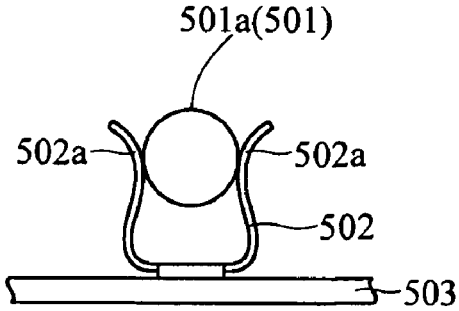
FIG.20 Prior Art
FIG. 20 A front view showing the structure of the connector member of the example of the conventional backlight device shown in FIG. 18.
Figure 21:
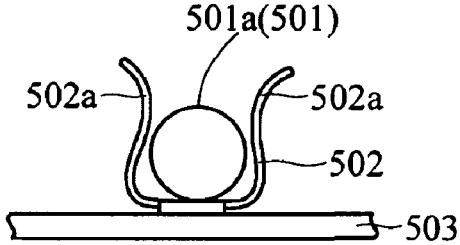
FIG.21 Prior Art
FIG. 21 A front view showing the structure of the connector member of the example of the conventional backlight device shown in FIG. 18.

Although the above embodiment deals with the case where the terminal portion (contact portions) of the cap portion of the cold cathode fluorescent lamp is formed into a cylindrical shape, the invention is not limited to this embodiment, and the terminal portion (contact portions) of the cap portion of the cold cathode fluorescent lamp may be formed into the shape of, for example, a quadrangular prism other than a cylinder. As with a cold cathode fluorescent lamp 223 in a third variation of the invention shown in FIG. 17, a terminal portion 223*c* of a cap portion 223*a* of the cold cathode fluorescent lamp 223 may be formed substantially in the shape of a circular plate, and part of the terminal portion 223*c* may protrude into contact portions 223*d*.

The invention claimed is:

1. A backlight device comprising:

a light source having a cap portion at an end portion of the light source; and a connector member connected electrically to the cap portion of the light source, wherein the cap portion of the light source includes a first contact portion extending in a first direction intersecting an axial direction of the light source;

the connector member includes a second contact portion making contact with the first contact portion of the cap portion; and a distance from a central axis of the light source to the second contact portion of the connector member is larger than a distance from the central axis of the light source to an end portion of the first contact portion of the cap portion in a second direction intersecting the first direction but is smaller than a distance from the central axis of the light source to an end portion of the first contact portion of the cap portion in the first direction.

2. The backlight device of claim 1, wherein the connector member includes a plurality of second contact portions provided as the second contact portion; and the plurality of second contact portions of the connector member are arranged such that a space therebetween is larger than a width of the first contact portion in the second direction but is smaller than a length of the first contact portion in the first direction.

3. The backlight device of claim 1, wherein, with the first contact portion of the cap portion not being in contact with the second contact portion of the connector member, the first contact portion of the cap portion is arranged in a predetermined position of the connector member, and the cap portion is thereafter turned a predetermined angle about the central axis of the light source such that the first contact portion of the cap portion is electrically connected to the second contact portion of the connector member.

4. The backlight device of claim 1, wherein the second contact portion of the connector member includes a plurality of protrusion portions and a recess portion arranged between the plurality of protrusion portions; and the first contact portion of the cap portion is arranged at the recess portion of the second contact portion of the connector member with the cap portion connected electrically to the connector member.

5. The backlight device of claim 4, wherein the plurality of protrusion portions of the connector member are formed to protrude toward the cap portion.

6. The backlight device of claim 5, wherein the second contact portion of the connector member is formed with a plate spring; and the first contact portion of the cap portion is arranged in a predetermined position of the connector member, then the cap portion is turned a predetermined angle about the central axis of the light source and thus the first contact portion of the cap portion comes in contact with one of the protrusion portions of the second contact portion of the connector member such that the second contact portion of the connector member protrudes less and that the second contact portion of the connector member stretches in a direction intersecting the axial direction of the light source.

7. The backlight device of claim 6, wherein the connector member includes a first regulation portion that regulates a movement of the second contact portion in the axial direction of the light source.

8. The backlight device of claim 1, wherein the connector member includes a second regulation portion that regulates a movement of the light source in the axial direction of the light source.

9. The backlight device of claim 1, wherein the cap portion is provided with an axis portion which extends in the axial direction of the light source and which is connected to the first contact portion; and the connector member includes an insertion portion into which the axis portion of the cap portion is inserted and which regulates a movement of the axis portion of the cap portion in a direction perpendicular to the axial direction of the light source.

10. The backlight device of claim 1, wherein the cap portion includes two first contact portions provided as the first contact portion and the two first contact portions are arranged symmetrically with respect to the central axis of the light source; and the connector member includes two second contact portions provided as the second contact portion and the two second contact portions are arranged parallel to each other to extend in a direction perpendicular to the axial direction of the light source.

11. The backlight device of claim 1, wherein the first contact portion of the cap portion is formed in a shape of a cylinder or a hollow cylinder.

12. The backlight device of claim 1, wherein a pair of cap portions provided as the cap portion is arranged on both end portions of the light source in the axial direction of the light source;

a pair of connector members provided as the connector member is arranged on outsides of the end portions of the light source in the axial direction of the light source; and the second contact portions of the pair of connector members sandwich the pair of cap portions in the axial direction of the light source.

13. A display device comprising:

the backlight device of claim 1; and a display panel illuminated by the backlight device.

14. A television receiver comprising:

the display device of claim 13;

a cabinet housing the display device;

a tuner; and a speaker.

* * * * *